US012201203B2

(12) United States Patent
Diane

(10) Patent No.: US 12,201,203 B2
(45) Date of Patent: Jan. 21, 2025

(54) UNIVERSAL AND REUSABLE VERSATILE DISPENSER

(71) Applicant: Mohamed Mory Diane, Gilbert, AZ (US)

(72) Inventor: Mohamed Mory Diane, Gilbert, AZ (US)

( * ) Notice: Subject to any disclaimer, the term of this patent is extended or adjusted under 35 U.S.C. 154(b) by 0 days.

(21) Appl. No.: 18/364,452

(22) Filed: Aug. 2, 2023

(65) Prior Publication Data

US 2024/0041178 A1 Feb. 8, 2024

Related U.S. Application Data

(60) Provisional application No. 63/370,443, filed on Aug. 4, 2022.

(51) Int. Cl.

| | |
|---|---|
| ***B43M 11/02*** | (2006.01) |
| ***A45D 33/12*** | (2006.01) |
| ***A45D 34/04*** | (2006.01) |
| ***A45D 40/06*** | (2006.01) |
| ***A45D 40/26*** | (2006.01) |
| *A45D 34/00* | (2006.01) |

(52) U.S. Cl.

CPC ..... *A45D 33/12* (2013.01); *A45D 34/041* (2013.01); *A45D 40/06* (2013.01); *A45D 40/261* (2013.01); *A45D 2034/005* (2013.01); *A45D 2200/052* (2013.01); *A45D 2200/053* (2013.01); *A45D 2200/054* (2013.01); *A45D 2200/155* (2013.01)

(58) Field of Classification Search

CPC ..... A45D 33/12; A45D 34/041; A45D 2034/005; A45D 40/261; A45D 2200/052; A45D 2200/155

USPC ..... 401/219, 1

See application file for complete search history.

(56) References Cited

U.S. PATENT DOCUMENTS

| | | | | |
|---|---|---|---|---|
| 3,397,027 | A | 8/1968 | Harrison | |
| 5,800,086 | A | 9/1998 | Piscopo et al. | |
| 6,155,736 | A * | 12/2000 | Evans | B05C 17/0357 401/209 |
| 6,890,115 | B2 | 5/2005 | Le Moing | |
| 9,908,140 | B2 | 3/2018 | Arwatz et al. | |
| 10,278,473 | B2 | 5/2019 | Groffsky et al. | |
| 11,110,486 | B2 * | 9/2021 | Gavriely | A61M 35/003 |
| 11,317,698 | B1 * | 5/2022 | Wise | A45D 40/02 |
| 2006/0122567 | A1 | 6/2006 | Kennedy | |
| 2009/0129848 | A1 * | 5/2009 | Tatarsky | A45D 34/041 401/6 |
| 2014/0153996 | A1 * | 6/2014 | Ammerman | A45D 34/041 401/219 |
| 2021/0282525 | A1 * | 9/2021 | Kuo | B26B 21/446 |

* cited by examiner

*Primary Examiner* — Jennifer C Chiang

(74) *Attorney, Agent, or Firm* — Vladimir Postnikov

(57) ABSTRACT

A dispenser includes a container designed to receive a cartridge with an open or partially open end, the cartridge featuring an internal cavity for storing a product and has open or partially open ends. Within the cavity, a movable platform engages the product to control its expulsion facilitated by a force exerting element that is inherently biased to move the platform. The dispenser also includes a roller at the container's end, which selectively restricts or permits product expulsion, allowing user control over the dispensing rate.

4 Claims, 5 Drawing Sheets

UNIVERSAL AND REUSABLE VERSATILE DISPENSER

CROSS REFERENCE AND PRIORITY

This application claims the benefit of U.S. Provisional Application No. 63/370,443, titled "Universal and reusable chemical media applicator (dispenser) apparatus" and filed Aug. 4, 2022, which is incorporated herein by reference in its entirety for all purposes.

TECHNICAL FIELD

The present invention pertains generally to dispensers for various products. More specifically, but without limitation, the present invention relates to a universal and reusable versatile dispenser that provides a user control over the rate of product dispensation.

SUMMARY OF THE INVENTION

A first primary embodiment comprises a container with a fillable internal cavity dimensioned to store a product. The product can be solid, semi-solid to liquid and powdery substances, commonly seen in the cosmetics and personal hygiene industry. This container has a first end and an open or partially open second end. Within this container, there is an either selectively attachable or permanently affixed movable platform that is specifically configured to engage with the stored product. This movable platform can effect a controlled expulsion of the product from the container through the open or partially open second end. The expulsion of the product is facilitated by at least one force exerting element, operationally connected to the platform. The force exerting element can either be selectively attachable or permanently affixed to the container. This force exerting element is inherently biased towards a direction that promotes movement of the platform to engage the product under influence of the force exerting element.

The force exerting element within the dispenser can take on various forms. This could include, but is not limited to, a spring, a block of foam, a diaphragm, an elastic cord, a sheet of flexible plastic, a piece of silicone rubber, or a chunk of polyurethane foam. Alternative options might encompass pneumatic or hydraulic bladders, a torsion spring, a compressed gas or air spring, a leaf-style spring, a piston, or a membrane. The element could also be a gel-filled pad, a sponge, or a combination of any of the aforementioned options.

Positioned at the second end of the container is a roller. This roller is designed to selectively restrict or permit the expulsion of the product from the container. This setup provides the user with control over the rate at which the product is dispensed, which directly relates to how fast or slow the roller rotates.

In various embodiments, the roller can be personalized to match the product and the surface where it will be applied. One option is to incorporate a sponge, scrub, or brush-like surface within the roller, allowing it to absorb the product and making it easier to dispense. Another possibility is to have textured surfaces, which can be used as spreading tools or massagers. Additionally, the roller might have undulations or ribs to agitate the product inside the container or create an uneven surface. These various configurations enable the product to be absorbed into or layered onto the roller and then applied to a surface. As a result, unique roller designs, shapes, and surfaces can be utilized to perfectly suit different types of products and application surfaces.

In various embodiments, the invention can incorporate a multitude of additional features that enhance the flexibility, control, and versatility of the dispenser, including, but not limited to:

A roller engagement mechanism can be operatively connected to the roller. This mechanism can be engaged by the user, allowing the user to selectively prevent the roller from moving or to allow it to move freely. This feature offers the user further control over the expulsion of the product from the container. Additionally, this design element fosters product conservation. It enables a user to stop the roller, letting them use up the entire product, or nearly so, that remains on the roller's surface. This functionality helps avoid accidental dispensing of more product by unintentional rotation of the roller. In other words, this feature allows the user to spread the product as needed while the roller is stabilized, preventing unnecessary product dispensing.

The movable platform within the container can be made flexible in order to serve a dual function. Not only does it act as a support for the product stored within, but its flexibility also allows it to act as a seal. This seal is effective in preventing the product from unintentionally migrating into the area between the platform and the first end of the container. This aspect of the design becomes especially advantageous in situations where the container's walls are not evenly spaced along the length between the first and second ends. The uneven spacing, often chosen for aesthetic or ornamental appeal, could potentially facilitate unintended product migration, making the seal created by the flexible platform crucial in such scenarios. However, if there are other means of sealing the cavity at disposal, these could be utilized as well. For example, in some embodiments, the alignment of the platform's sides with the internal sides of the container, providing a snug fit, serves as an effective seal as the platform moves.

A collar fitting can be included in the design. This collar fitting can be either selectively attachable or permanently affixed to the open end of the container. The collar fitting is designed to work in cooperation with the roller to facilitate the optimal dispensation of the contained product. Distinct collar fittings can be tailored to best suit different types of products. In certain embodiments, the collar is specifically configured to secure the roller to the container.

The invention can also comprise a heating mechanism incorporated either selectively attachable or permanently affixed to the container. This heating mechanism is designed to warm the contained product upon activation. Warming the product can assist in its optimal dispensation from the container. Moreover, this heating feature can be advantageous for users who prefer applying the product at a warmer temperature.

A product insertion tool can be detachably coupled to the container. This tool aids a user in refilling an empty or partially filled internal cavity.

The container can incorporate a clear or semi-clear visual indicator, enabling users to easily determine the remaining quantity of the product inside via visual inspection. In some designs, this might manifest as a narrow clear or semi-clear strip running along the length of the container from the first end to the second. In other versions, a smaller portion, a larger portion, or the entire container, may be made clear or semi-clear for easy visibility of the product level.

The dispenser can also include a motor operationally linked to the roller and a motor engagement mechanism.

When the user interacts with the motor engagement mechanism, it instigates the rotation of the roller.

In some embodiments, the motor can be operationally linked to the force exerting element. This means that when the user interacts with the motor engagement mechanism, it instigates a forceful action against the platform.

In some embodiments, the use of a motor promotes the vibration of the dispenser which can be useful to massage, soothe and stimulate the area of application.

In some embodiments, there are multiple motor engagement mechanisms that, when interacted with by a user, trigger different actions respectively.

The roller can be comprised of two or more modular interconnectable segments. In the preferred embodiment, the segments are identical. This modular design boosts the flexibility and adaptability of the roller mechanism. From a production perspective, a roller made up of several identical modular segments can be more economically and efficiently manufactured using injection molding techniques, compared to a roller composed of a single segment if that segment is internally hollow and the hollow area is fully and non-detachably enclosed.

The dispenser can also comprise a lid that can be detachably attached to the second end of the container. Upon complete attachment, the lid can prevent the roller from interfacing with other surfaces. In some variations of the design, the lid can be fully removable, whereas in others, it might be attached via a hinge for easy opening and closing.

In a second primary embodiment, the dispenser is designed to receive a cartridge. The cartridge defines a fillable internal cavity dimensioned to store a product, and it has an open or partially open first end and an open or partially open second end. The movable platform and the force exerting element are positioned and function in the same way as in the container. All the additional potential embodiments, such as those that include the flexible platform, the collar fitting, the heating mechanism, the product insertion tool, the clear or semi-clear visual indicator, the motor, the lid, the roller engagement mechanism, and the roller composed of interconnectable segments, can also be applied to this second primary embodiment.

The use of a removable reusable/refillable and/or environmentally friendly disposable cartridge with the dispenser has several clear advantages. One of the most significant being the ease of cleaning it offers to the user. When a cartridge system is implemented, it effectively separates the internal product storage from the dispenser itself. This means that instead of having to clean the entire dispenser's internal cavity—a task that can be both difficult and time-consuming, particularly if the dispenser has complex mechanisms or is not designed to be easily disassembled—the user needs to only clean the cartridge if a reusable/refillable one is used. The dispenser overall is designed to be dishwasher safe, or at the very least, hand washable. However, the feature of being able to simply clean the reusable or refillable cartridge makes the upkeep much less burdensome.

Another advantage of using an internal cartridge system is the modularity it brings to the product design. Modularity enables the user to switch between different cartridges, which may contain different products or versions of a product, quickly and with minimal effort. This feature is particularly advantageous in a commercial setting, where different users might have different product preferences.

In addition, the environmental benefits of using a reusable cartridge are considerable. By reusing and refilling the dispenser, users can significantly reduce the amount of waste produced by the disposal of single-use containers. This also cuts down on the resources and energy used to manufacture these containers, making the product life cycle more sustainable overall. Consequently, the reusable/refillable and/or environmentally friendly disposable cartridge system presents an eco-friendly solution that aligns with increasing consumer awareness and demand for sustainable products.

BRIEF DESCRIPTION OF THE DRAWINGS

The invention will be readily understood by the following detailed description in conjunction with the accompanying drawings, wherein like reference numerals designate like structural elements, and in which.

DETAILED DESCRIPTION OF THE INVENTION

Figure 1:
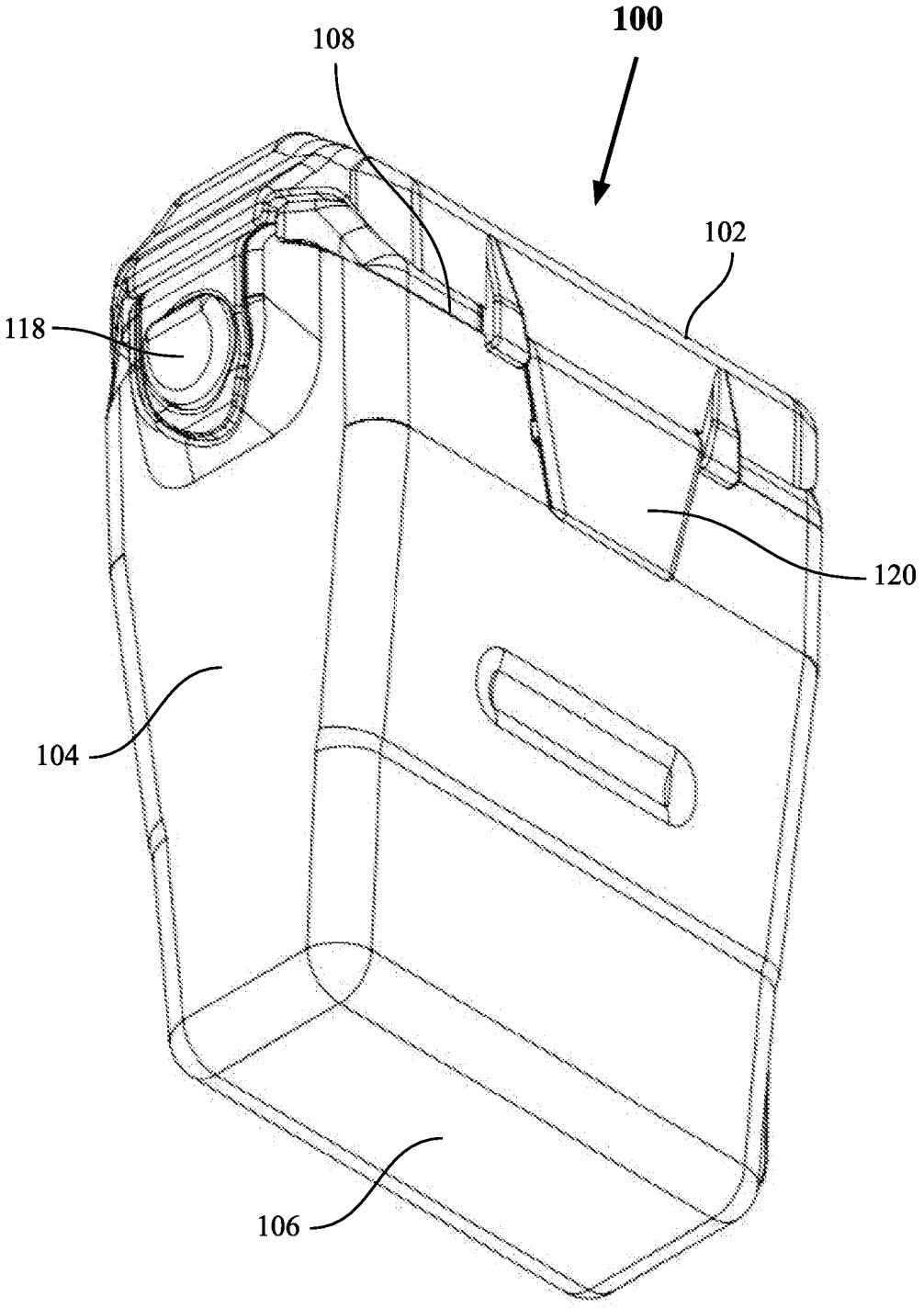
FIG. 1 is a front perspective view of a dispenser according to one embodiment of the present invention.

In the following description, to better understand the aforementioned purposes, features, and advantages of the present invention, numerous specific details are set forth in order to provide a thorough understanding of the claimed subject matter. It should be noted that these details and examples are provided to merely aid in understanding the descriptions, and they do not, in any way, limit the scope of the present invention. The present invention can also be implemented in other modes different from those described herein and the present invention is not limited to the specific embodiments disclosed below.

As used herein, the singular forms "a", an" and "the" are intended to include the plural forms as well, unless expressly stated otherwise, It will be further understood that the terms "includes", comprises", including" and/or "comprising" when used in this specification, specify the presence of stated features, integer steps, operations, elements and/or components, but do not preclude the presence or addition of one or more other features integers, steps, operations, elements, components, and/or groups thereof. As used herein, the term "and/or" includes any and all combinations and arrangements of one or more of the associated listed items.

Unless otherwise defined, all terms (including technical and scientific terms) used herein have the same meaning as commonly understood by one of ordinary skill in the art to which this disclosure pertains. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

No element, act, or instruction used herein should be construed as critical or essential unless explicitly described as such.

The dispenser's design lends itself to accommodating a broad spectrum of product consistencies, ranging from solid and semi-solid to liquid and powdery substances, commonly seen in the cosmetics and personal hygiene industry. To cater to these different products, the user can adapt the dispenser in several ways.

For example, solid products like deodorant sticks or lip balms can be conveniently dispensed through a roll-on mechanism. In situations where semi-solid substances such as gels, creams, or pastes are used—common in skincare or haircare products—which might stick to the container's walls, a refillable and easily cleanable cartridge can be utilized.

For substances that flow freely, like liquids or powders, a specific roller and collar fitting setup may be required to ensure optimal, leak-free dispensing and application. Traditionally, these substances are applied by shaking or tilting the dispenser, using gravity to help the liquid or powder engage with the roller. However, by taking advantage of the seal formed by the platform and the force from a force exerting element, these substances can be easily applied to a surface while keeping the dispenser in an upright position.

Moreover, the dispenser can include a heating mechanism, ideal for certain products that benefit from warmth, such as massage oils or wax, enhancing their application and absorption. For powdery substances like makeup powders or dry shampoos, a specific roller might be used to evenly distribute the product, while a vibrator could be utilized to ensure a consistent flow of the product from the container or to massage, soothe, and stimulate the area of application.

Different collar fittings can be used to match the type of product and its application method, allowing for efficient dispensation. The overall design flexibility of the dispenser enables it to cater to a wide array of product types, underscoring its versatility in the cosmetics and personal hygiene industry.

Figure 2:
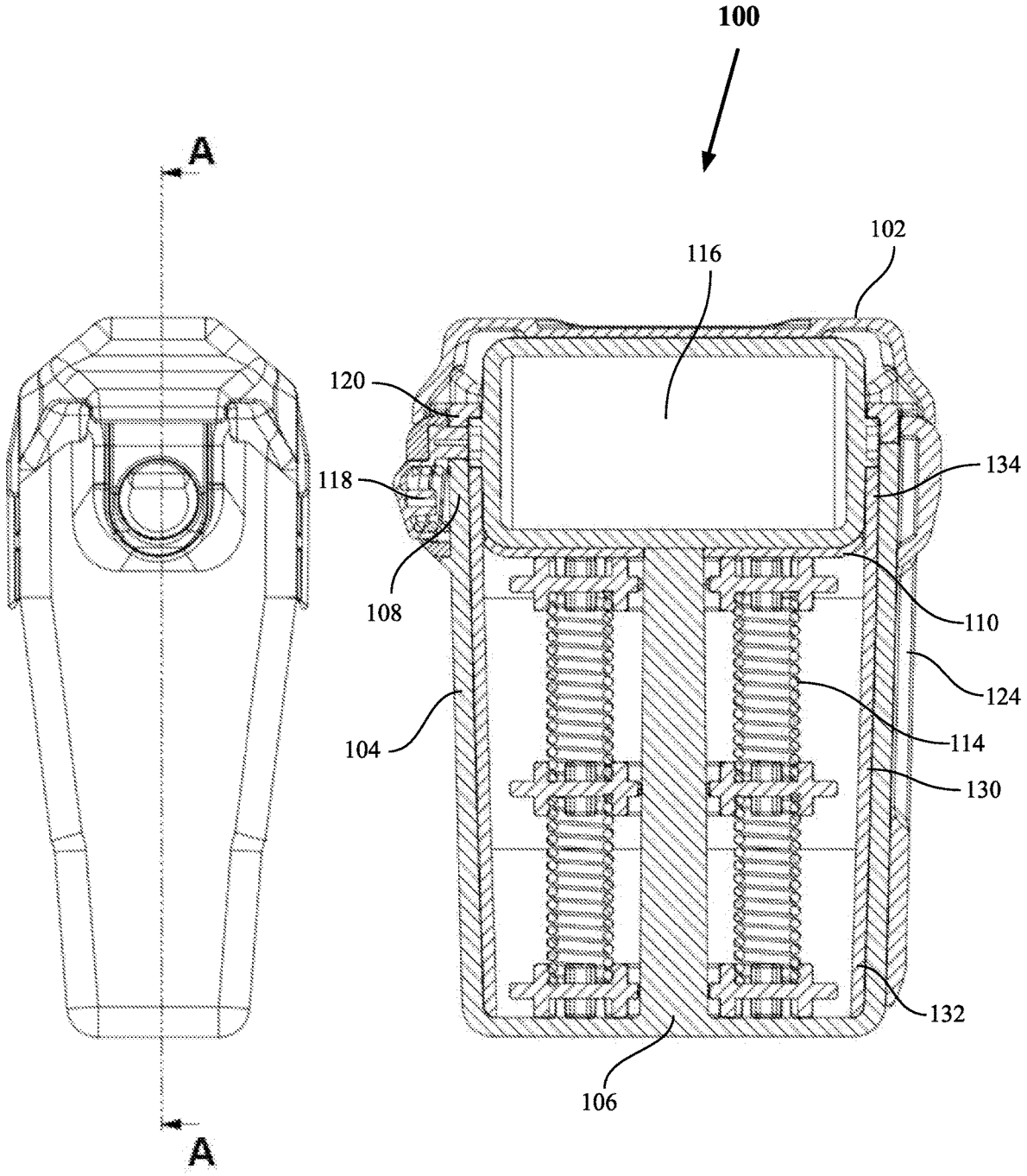
FIG. 2 is a front elevation cross-sectional view of the dispenser along sectional line A-A.
Figure 3:
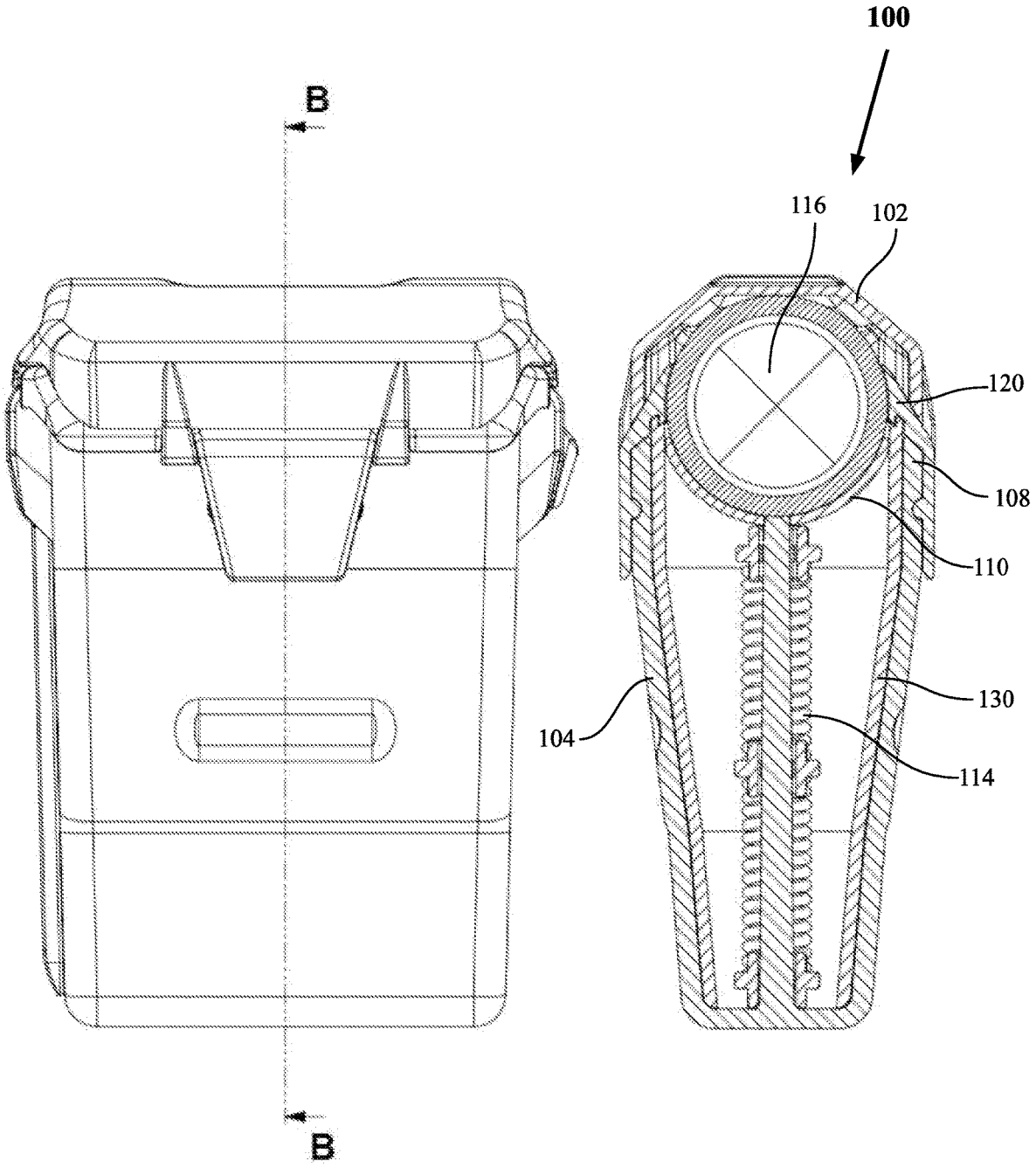
FIG. 3 is a right side cross-sectional view of the dispenser along sectional line B-B.

Referring now to the drawings in detail, wherein like numerals indicate like elements throughout the several figures, FIGS. 1 to 3 illustrate a dispenser 100 according to one embodiment of the present invention.

FIG. 1 illustrates a front perspective view of the dispenser 100 according to one embodiment of the present invention. As visible from the exterior, the dispenser 100 comprises a container 104, a lid 102, a roller engagement mechanism 118, and a collar fitting 120.

The container 104 has a first end 106 and an open second end 108. The container 104 also defines a fillable internal cavity dimensioned to store a product and/or a cartridge 130. The lid 102 can be detachably connected to the second end 108 of the container 104. When the lid 102 is fully secured as depicted, it serves to prevent the roller 116 from coming into contact with any extraneous surfaces.

The roller engagement mechanism 118 is operatively connected to the roller and provides the user with precise control over the product's dispensation rate, allowing for more efficient and economical use of the product.

In the depicted embodiment, a button-based system is utilized. In this button-based system, the button is linked mechanically to the roller 116 through actuation of the roller engagement mechanism 118. When the button is pressed or actuated by a user, it triggers the roller engagement mechanism 118, which in turn affects the movement of the roller 116. The roller engagement mechanism 118 functions as a spring-loaded stem that slots into a hole or groove in the roller 116. In the depicted embodiment, when the button is pressed, it engages a braking mechanism within the roller engagement mechanism 118. This braking mechanism can physically block the rotation of the roller 116, effectively preventing the roller from moving and halting the dispensing of the product. In practice, this could be implemented through various means such as a pin that slots into a hole or groove in the roller, or a clamping device that tightens around the roller.

Alternatively, when the button is released or reset, the braking mechanism is disengaged. This allows the roller 116 to rotate freely once again, permitting the expulsion of the product from the container 104. The button can function through a simple push-release mechanism, where a single push engages or disengages the braking system, or it could work on a push-push mechanism, where one push engages the brake, and a subsequent push releases it.

Figure 8:
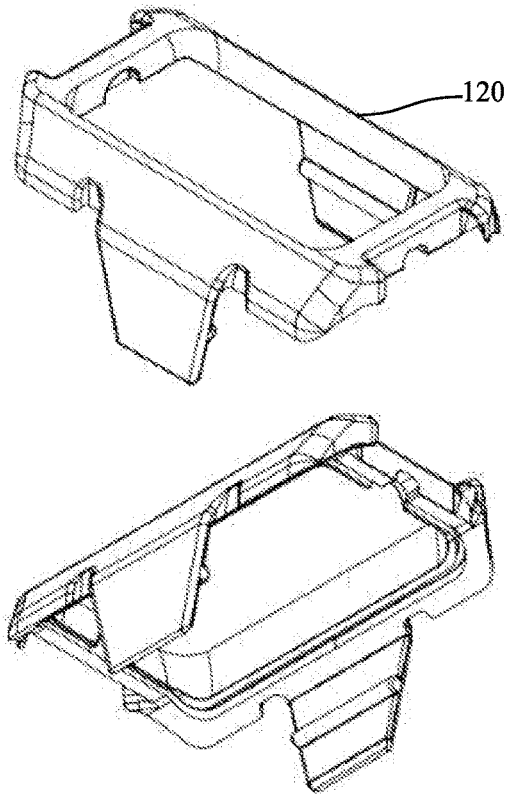
FIG. 8 are perspective views of the collar fitting of the dispenser of FIG. 1.

In this embodiment, the collar fitting 120 secures the roller 116 to the container 104. This connection is carefully designed to remain effective regardless of whether a cartridge 130 is used or not, ensuring that the roller 116 can reliably dispense the product in various configurations. This universality allows for a singular collar fitting 120 to accommodate a wide variety of dispensing needs, contributing to the dispenser's versatility and modularity. Furthermore, in this embodiment, locking grooves are used near the second end of the container. The collar's arms (see FIG. 8) latch onto these grooves to secure the roller.

As shown in FIG. 2, within the container 104, there is the either selectively attachable or permanently affixed movable platform 110 that is specifically configured to engage with the product. The expulsion of the product is facilitated by the either selectively attachable or permanently affixed force exerting element 114 which is operationally connected to the platform 110. In this embodiment, the force exerting element 114 is inherently biased towards the second end 108, promoting the movement of the platform 110 from the first end 106 towards the second end 108 under the influence of the force exerting element 114.

Positioned at the second end 108 of the container 104 is the roller 116. This roller 116 is designed to selectively restrict or permit the expulsion of the product from the container 104, providing the user with control over the rate at which the product is dispensed.

Figure 5:
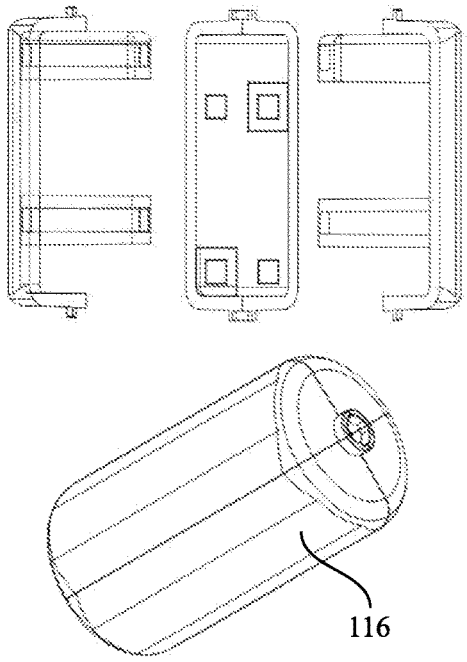
FIG. 5 are exploded and perspective views of the modular roller segments and assembled roller, respectively, of the dispenser of FIG. 1.

As seen in FIG. 5, the roller may be comprised of two or more interconnectable modular segments, ideally identical. This design enhances the roller mechanism's flexibility and adaptability. From a manufacturing standpoint, a roller composed of identical modular segments can be produced more cost-effectively and efficiently using injection molding techniques. In such cases, this method is particularly beneficial compared to creating a roller from a single segment if that segment is internally hollow and the hollow area is permanently enclosed.

The movable platform 110 within the container 104 can be made flexible. Not only does it act as a support for the product stored within, but its flexibility also allows it to act as a seal that prevents unintentional product migration into the area between the platform 110 and the container's first end 106. This feature becomes notably beneficial when the container's walls are unevenly spaced such as the depicted embodiment, which could otherwise lead to unintended product movement.

Figure 7:
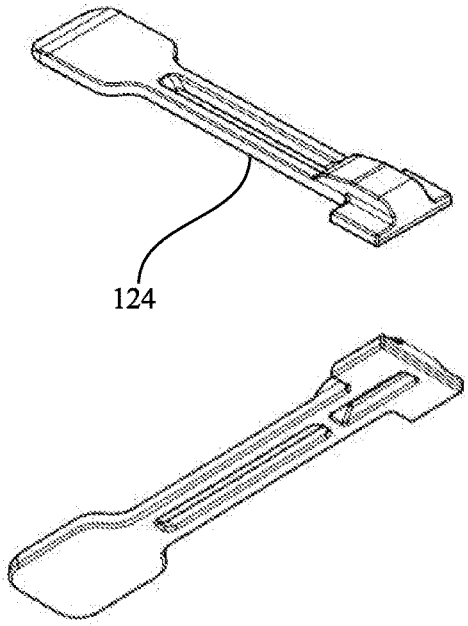
FIG. 7 are perspective views of the product insertion tool of the dispenser of FIG. 1.

The product insertion tool 124 (see FIG. 7) can be detachably coupled to the container 104, aiding a user in refilling an empty or partially filled internal cavity.

Figure 6:
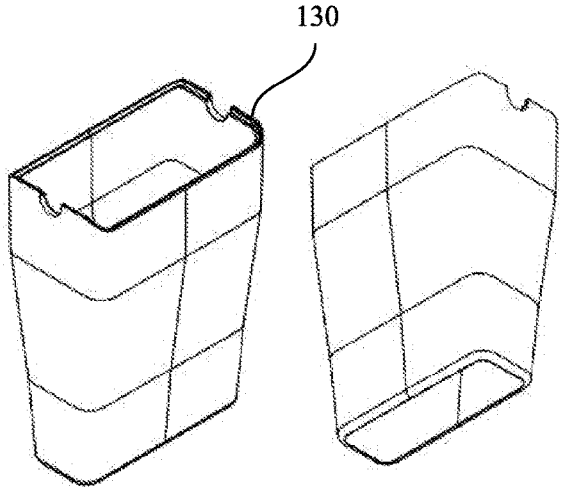
FIG. 6 are perspective views of the cartridge of the dispenser of FIG. 1.

As illustrated in FIGS. 2, 3 and 6, the container 104 is designed to receive a cartridge 130. The cartridge 130 defines a fillable internal cavity dimensioned to store a product, and it has an open first end 132 and an open second end 134. The movable platform 110 and the force exerting element 114 are positioned and function in the same way as in the container 104.

The use of a removable reusable/refillable and/or environmentally friendly disposable cartridge system 130 offers several clear advantages, including ease of cleaning, modularity, and environmental sustainability. By separating the internal product storage from the dispenser, it simplifies maintenance by enabling the user to clean just the cartridge if a reusable/refillable one is used, which is typically easier and less time-consuming than cleaning the whole dispenser. The cartridge's modularity allows for quick product switches, beneficial in settings where varied user preferences exist. Importantly, reusable cartridges significantly reduce waste and resource usage, promoting a more sustainable product lifecycle, aligning with growing consumer demands for eco-friendly solutions.

In certain scenarios, environmentally friendly disposable cartridges might be provided, sealed at both ends with a well-secured but removable cap or a thin, easily penetrable or removable material like tinfoil, to contain the product until its use. This serves to maintain the product's integrity during storage and transportation, preventing contamination and spillage. Once the user is ready to use the product, they simply insert the cartridge into the container of the dispenser. To facilitate this, the platform might be pre-installed in the cartridge along with the product before the cartridge is sealed. If a thin seal is used, the force exerting element—already situated within the container—punctures the material sealing the cartridge's first end. This allows the product to be dispensed when the platform applies force on it. This design allows for an easy and efficient transition from storage to use, ensuring product freshness and convenience for the user.

Figure 4:
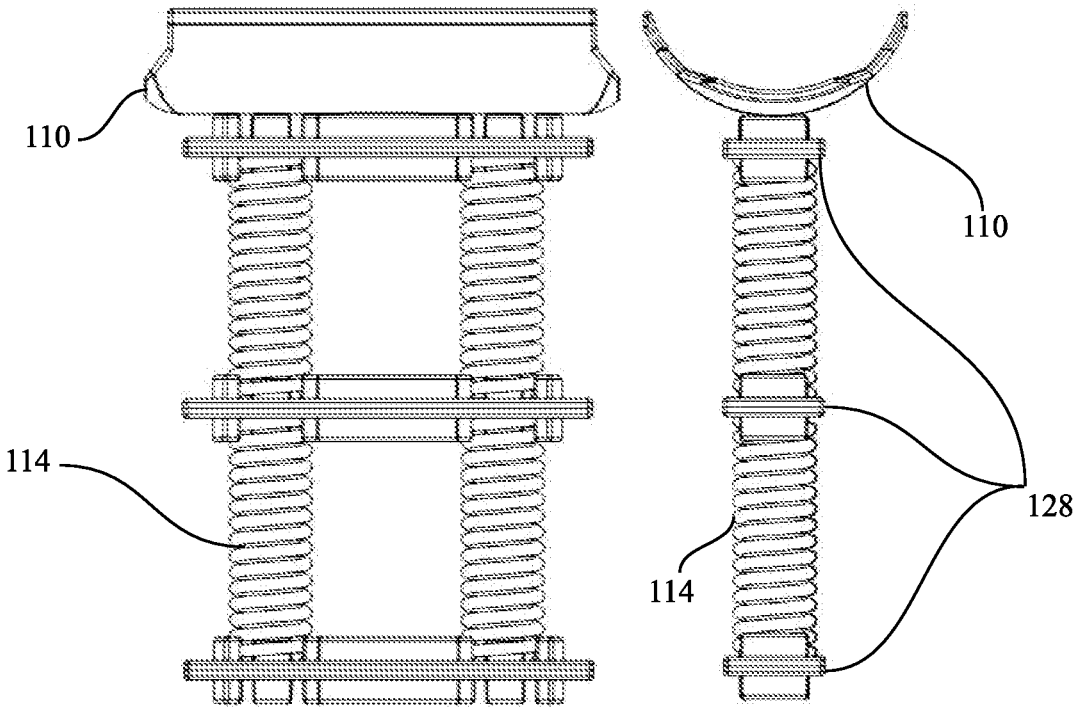
FIG. 4 are front elevation and right side views of the force exerting element and platform of the dispenser of FIG. 1.

As illustrated in FIG. 4, one or more stabilizing elements 128 can be used to stabilize and secure the one or more force exerting elements 114 as the platform moves along the interior of the container 104 or cartridge 130.

Stabilizing elements 128 for a system that uses springs as force exerting elements could include mechanical stabilizers, such as guide rods or tracks, that keep the spring and the associated platform aligned within the container or cartridge. In some embodiments, the stabilizing elements might also include tension control mechanisms that provide the ability to adjust the tension of the spring, offering greater control over the force exerted by the spring.

In some embodiments, the container 104 and cartridge 130 can incorporate a clear or semi-clear visual indicator (not shown), enabling users to easily determine the remaining quantity of the product inside via visual inspection.

In some embodiments, the dispenser's functionality can be enhanced through the incorporation of a motor operationally connected to the roller and a motor engagement mechanism (not shown) such as a button. This linkage enables the motor to drive the roller's rotation when the user interacts with the motor engagement mechanism. This automated rotation of the roller can simplify the application process, making it easier and more efficient for the user, especially when dispensing viscous or semi-solid products.

In other embodiments, the motor is operationally linked to the force exerting element 114. This connection enables the user to initiate a forceful action against the platform 110 when they engage the motor engagement mechanism. This feature can assist in dispensing solid or thick products, offering an additional push that may be crucial in certain scenarios, especially when the inherent force generated by the force exerting element 114 alone is not sufficient for the optimal dispensation of the product.

Furthermore, the dispenser can feature multiple motor engagement mechanisms, each corresponding to a distinct action when engaged by the user. For instance, one mechanism could activate the roller's rotation, while another could initiate force against the platform. Yet another motor engagement mechanism might power an intentionally designed vibrating mechanism. This vibration could serve several purposes, such as aiding in the dispersal of powdery substances, enhancing the absorption of liquid or gel products, or providing a massaging effect during application. The motor could also inherently provide a gentle vibration during regular use, adding a sensory aspect to the product's application that enhances the user's experience.

In some embodiments, the heating mechanism (not shown) can be incorporated either selectively attachable or permanently affixed to the container 104. This heating mechanism is designed to warm the contained product upon activation.

In some embodiments, the open second end 108 is not disposed directly opposite the first end 106 of the container 104 as seen in the embodiment of FIG. 1. For example, the open second end 108 can be positioned on a side of the dispenser 100 and designed to cooperate with the roller 116 to dispense the contained product from the side of the dispenser 100. In such embodiments, the force exerting element 114 may be inherently biased toward a direction not aligned with the direction of the product's dispersal.

In some embodiments, the roller 116 is customizable to best suit the product and the application surface. Different designs may include a sponge, scrub, or brush-like texture for better product absorption and easier dispensing, textured surfaces for spreading or massaging, or ribbed and undulating surfaces for product agitation. These varied designs ensure effective product application and can be uniquely tailored for different product types and surfaces.

In some embodiments, the roller 116 and collar fitting 120 are specially configured to empower the user with the ability to readily interchange rollers 116 based on the characteristics of the product contained within the container 104 or the cartridge 130. The easy swapability of rollers 116 thus enhances the versatility and user-friendliness of the dispenser 100.

In some embodiments, the lid 102 may be affixed through a hinge positioned on the second end 108 of the container 104 or on the collar fitting 120.

In some embodiments, the roller 116 is constructed to be normally in a locked or static position, and only rotates when the roller engagement mechanism 118 is actively engaged by the user. This is a unique approach where the roller's default state is static, rather than free-moving, providing an added layer of control over product dispensation.

This mechanism can be implemented by the incorporation of a motor linked to the roller and which shaft's default position is locked, or a spring-loaded component within the roller engagement mechanism 118. In the roller's default state, this component holds the roller 116 in place, preventing any inadvertent product dispensation due to unwanted roller movement. This could be achieved through similar means as before, like a stem, pin, or a clamping device, exerting pressure on the roller to keep it stationary.

However, when a user engages the roller engagement mechanism 118, such as by pressing a button or flipping a switch, the locking component is temporarily disengaged. This frees up the roller 116, allowing it to rotate and dispense the product from the container.

This embodiment is particularly useful in applications where precision is required, or in scenarios where unintentional dispensing of the product needs to be avoided. Once the user disengages the roller engagement mechanism 118, the locking component returns to its original state, locking the roller 116 back into its static position and preventing any further product dispensation until the next intentional user interaction.

In some embodiments, other sealing methods can be utilized to stop the product from moving into unintended areas. For example, when the side walls of the container 104 or the cartridge 130 are consistently spaced apart, the platform's sides can be aligned with the internal sides, creating a snug fit. This fit can effectively seal the cavity as the platform 110 moves.

In some embodiments, the force exerting element 114 can be manually assisted by a user. This flexibility allows the user to exert additional force on the platform 110 if needed, providing greater control over the dispensation of the product, particularly when dealing with thicker or more solid products.

Although the present invention has been described in detail with reference to certain preferred configurations thereof, other embodiments are possible. Therefore, the spirit and scope of the invention should not be limited to the embodiments described above.

What is claimed is:

1. A dispenser comprising:

a container, the container defining a fillable internal cavity dimensioned to store a product, the container further having a first end and an open or partially open second end;

a movable platform positioned within the internal cavity, the platform configured to engage the product and effect a controlled expulsion of the product from the container through the open or partially open second end, the expulsion facilitated by at least one force exerting element operationally connected to the platform, wherein the force exerting element is inherently biased towards a direction that promotes movement of the platform to engage the product under influence of the force exerting element, and wherein the force exerting element is configured to continuously exert force after being pushed down; and, a roller situated at the second end of the container, the roller being configured to selectively restrict or permit the expulsion of the product from the container, thereby providing user control over the rate of product dispensation;

wherein the movable platform is flexible and designed to operate as a seal, inhibiting the product from migrating into the region of the internal cavity encapsulated by the movable platform and the first end of the container; and wherein the walls of the container are not evenly spaced along the length between the container's first and second ends.

2. A dispenser comprising:

a container dimensioned to receive a cartridge and having an open or partially open end;

a removable cartridge, the cartridge defining a fillable internal cavity dimensioned to store a product, the cartridge further having an open or partially open first end and an open or partially open second end;

a movable platform positioned within the internal cavity, the platform configured to engage the product and effect a controlled expulsion of the product from the container through the open or partially open second end, the expulsion facilitated by at least one force exerting element operationally connected to the platform, wherein the force exerting element is inherently biased towards a direction that promotes movement of the platform to engage the product under influence of the force exerting element; and, a roller situated at the open or partially open end of the container, the roller being configured to selectively restrict or permit the expulsion of the product from the container, thereby providing user control over the rate of product dispensation.

3. The dispenser of claim 2, further comprising a roller engagement mechanism, wherein the roller engagement mechanism is operatively connected to the roller and is adapted to be engaged by a user, the engagement of the roller engagement mechanism by the user configured to selectively prevent the roller from moving or allow the roller to move freely, thereby providing further control over the expulsion of the product from the container.

4. The dispenser of claim 2, wherein the movable platform is flexible and designed to operate as a seal, inhibiting the product from leaking into the region of the internal cavity encapsulated by the movable platform and the first end of the cartridge.

* * * * *